US005975833A

United States Patent [19]

Yamada et al.

[11] Patent Number: 5,975,833

[45] Date of Patent: Nov. 2, 1999

[54] SWING TYPE HYDRAULIC EXCAVATOR

[75] Inventors: Kazuyoshi Yamada, Ibaraki-ken; Masashi Kobori, Tsuchiura; Takaharu Nishimura, Ishioka, all of Japan

[73] Assignee: Hitachi Construction Machinery Co., Ltd., Tokyo, Japan

[21] Appl. No.: 08/913,993

[22] PCT Filed: Jan. 28, 1997

[86] PCT No.: PCT/JP97/00182

§ 371 Date: Sep. 29, 1997

§ 102(e) Date: Sep. 29, 1997

[87] PCT Pub. No.: WO97/28316

PCT Pub. Date: Aug. 7, 1997

[30] Foreign Application Priority Data

Jan. 30, 1996 [JP] Japan ..... 8-014104

[51] Int. Cl.[6] ..... E02F 5/00

[52] U.S. Cl. ..... 414/687; 212/232; 212/300

[58] Field of Search ..... 414/687, 688, 414/694, 695.5, 685, 680; 212/300, 231, 232

[56] References Cited

U.S. PATENT DOCUMENTS

| | | | |
|---|---|---|---|
| 4,728,251 | 3/1988 | Takashima et al. | 414/695.5 X |
| 4,797,060 | 1/1989 | Kishi et al. | 414/687 |

FOREIGN PATENT DOCUMENTS

| | | |
|---|---|---|
| 61-71643 | 5/1986 | Japan . |
| 2-84857 | 7/1990 | Japan . |
| 3-255241 | 11/1991 | Japan . |
| 5-125743 | 5/1993 | Japan . |
| 6-220888 | 8/1994 | Japan . |
| 7-11664 | 1/1995 | Japan . |
| 7-243223 | 9/1995 | Japan . |

*Primary Examiner*—Donald W. Underwood
*Attorney, Agent, or Firm*—Beall Law Offices

[57] ABSTRACT

An upper cover has a curved portion formed in its end portion on the side near a work front for avoiding interference with the work front. The curved portion comprises a recessed surface having a center axis aligned with the axis of a vertical pin of a swing post, a first stepped portion provided at a lower end of the recessed surface and defining a substantially constant gap with respect to a locus drawn by a rear projecting portion of the swing post when the work front is swung, and a second stepped portion provided in an intermediate portion of the recessed surface in the direction of height thereof and having a substantially horizontal surface for assuring a foothold. The recessed surface is configured to extend along a locus drawn by a back surface of the boom when the work front is swung in its minimum-turn posture, while defining a gap with respect to the locus. The first stepped portion has a substantially vertical curved surface formed in continuation with the lower end of the recessed surface and defining a substantially constant gap with respect to the locus drawn by the rear projecting portion of the swing post when the work front is swung, and a substantially horizontal surface formed in continuation with adjacent the curved surface on the side near the work front and defining a substantially constant gap with respect to a locus drawn by a lower end of the rear projecting portion of the swing post when the work front is swung.

4 Claims, 11 Drawing Sheets

SWING TYPE HYDRAULIC EXCAVATOR

TECHNICAL FIELD

The present invention relates to a hydraulic excavator comprising a traveling carriage and a turning structure turnably mounted on the traveling carriage, and more particularly to a swing type hydraulic excavator with a boom capable of swinging to the left and right in a position on the front end side of the turning structure to carry out excavating, e.g., digging of a side trench.

BACKGROUND ART

Recently, an attention has been focused on small-turn type hydraulic excavators wherein a work front is designed to be able to turn with a small radius so that the excavator can work in a narrow place. It is essential for these small-turn type hydraulic excavators to have a function of enabling a side trench to be dug in a position near and transversely of an excavator body without changing the body position. To this end, hydraulic excavators of the offset and swing types have been proposed. There are known the following examples (1) an example of the offset type and (2), (3) examples of the swing type.

(1) JP, A, 3-255241

According to this known art, an arm is made up of an offset arm coupled to a front end of a boom in such a manner as to be able to be offset to the left and right, and a bucket arm capable of pivotally moving up and down with respect to the offset arm while being kept parallel to the boom. This known art also discloses a structure in which a longitudinal groove is formed in an upper cover, which covers most of an area over a turning frame except for the cab, to prevent interference between the boom and the upper cover when the boom is maximally lifted upward.

(2) JP, A, 5-125743

This known art discloses a swing type hydraulic excavator wherein a boom is swingable to the left and right about a swing post in a position on the front end side of a turning structure.

(3) JP, A, 7-243223

This known art discloses a structure that, in a swing type hydraulic excavator similar to that of the above (2), includes a boom having a two-piece boom made up of a lower boom capable of pivotally moving up and down with respect to a swing post and an upper boom capable of pivotally moving up and down with respect to the lower boom, and an opening angle adjusting means for changing an angle between the lower boom and the upper boom depending on the angle of pivotal movement of the lower boom.

DISCLOSURE OF THE INVENTION

Meanwhile, in general, the area over a turning frame of a hydraulic excavator except for the cab is covered by an upper cover, and various equipment such as a prime mover, a hydraulic pump and a tank are installed inside the upper cover. Therefore, the upper cover is required to have a necessary minimum volume sufficient to install the equipment.

In the offset type hydraulic excavator of the above known art (1), the longitudinal groove into which a back portion of the boom comes into contact when the boom is lifted rearwardly upward, is formed in the upper cover. But, because the boom of the offset type hydraulic excavator is just lifted up and down, the presence of the longitudinal groove brings about a so small reduction in the volume defined by the upper cover that the necessary equipment can be installed inside the upper cover. Also, because the boom can be inclined rearward to a large extent, it is possible to reduce the radius of turn of the work front in its minimum-turn posture.

In the offset type hydraulic excavator, however, a complex parallel link mechanism and a cylinder for driving the parallel link mechanism are provided on an upper portion (upper boom) of the work mechanism or front. Accordingly, the weight of the work front mechanism is increased, resulting in the problems below.

(1) Because of a substantial increase in weight of the work front, the position of the center of gravity is displaced toward the distal end of the work front depending on the posture of the work front, and therefore stability of the excavator tends to become worse.

(2) Because of the increased weight of the work front, the weight of a counterweight is also required to be increased. Hence, the total weight of the offset type excavator is comparable to that of a standard excavator of the not offset type which has an excavation ability ranked to one-class higher in level of excavators, resulting in a greater transportation cost.

(3) Because of an increase in weight of the excavator body, the prime mover is required to have a greater output and both the manufacture cost and the running cost are increased.

Further, since the arm and the bucket are offset parallel to the boom, the offset type hydraulic excavator also has the problems below.

(4) With the lower boom and the upper boom coupled to each other by a vertical pin, when crushing work is performed by using a front attachment, e.g., breaker, which generates great impact force and vibration in the digging direction, damage such as bending of the vertical pin tends to occur.

(5) When a side trench is excavated to be deep, there is a risk that a lower portion of the parallel link mechanism may interfere with the ground surface. Accordingly, a digging depth can not be made so deep as that achieved by a standard excavator of the not offset type.

(6) Because of the complex parallel link mechanism, the manufacture cost is increased and the efficiency of maintenance is deteriorated.

(7) When the arm and the bucket are offset to the side opposite to the cab, the field of view of the operator is obstructed by the boom and the position under digging is less clearly viewed from the operator in the cab.

In contrast with the above offset type hydraulic excavator, swing type hydraulic excavators as disclosed in the above documents (2) and (3) have no complex parallel link mechanisms in the upper portion of the work front, do not suffer from such an increase in weight as resulted in the offset type, and are free from the problems caused by the offset movement of the arm and the bucket.

The swing type hydraulic excavators, however, have the problem below for the fact that the work front not only rotates vertically, but also swings horizontally. When the boom is inclined rearward to a large extent, a region in which the boom and the upper cover may interfere with each other is increased and a reduction in volume defined by the upper cover is so increased correspondingly that all of the necessary equipment cannot be installed inside the upper cover. For that reason, it has been required up to date that the angle by which the boom is inclined rearward is made small, or that a vertical pin defining the center of swing is set to a forward position. This has resulted in that the radius of turn of the work front in its minimum-turn posture can not be reduced.

An object of the present invention is to provide a swing type hydraulic excavator having no complex parallel link mechanism in an upper portion of a work front, which can minimize a reduction in volume defined by an upper cover and can reduce the radius of turn of the work front in its minimum-turn posture.

To achieve the above object, according to the present invention, there is provided a swing type hydraulic excavator comprising an under traveling carriage, a turning frame turnably mounted above the under traveling carriage, a swing post attached to the turning frame rotatably in the horizontal direction about a vertical pin, a work front attached to the swing post rotatably in the vertical direction and including a boom, a cab provided on the turning frame on one side in the direction of body width, and an upper cover covering most of an area over the turning frame except for the cab and housing equipment such as a prime mover, a hydraulic pump and a tank therein, the boom of the work front being inclined rearward to a position laterally of the cab when the boom is maximally lifted upward to take a minimum-turn posture of the work front where the boom is closest to the upper cover, thereby reducing a radius of turn of the work front in the minimum-turn posture, wherein a curved portion for avoiding interference with the work front is formed in an end portion of the upper cover on the side near the work front, and the curved portion includes a recessed surface configured to have a center axis aligned with an axis of the vertical pin and extend along a locus drawn by a back surface of the boom when the work front is swung in the minimum-turn posture, while defining a gap with respect to the locus.

Specifically, when the work front is swung in the minimum-turn posture with the boom positioned closest to the upper cover, the back surface of the boom draws a locus substantially in the form of, e.g., an inverted cone, having a center axis aligned with the axis of the vertical pin, because the boom is vertically rotatably attached to the swing post which is attached to the turning frame turnably about the vertical pin. Accordingly, when the boom is going to be inclined rearward to a large extent in the minimum-turn posture, the boom and the upper cover would interfere with each other somewhere in the above locus if the upper cover has no recessed surface portion. In the present invention, therefore, the recessed surface which is configured to have the center axis aligned with the axis of the vertical pin and extend along the above locus while defining a gap with respect to the above locus, is formed in the curved portion which is formed in the end portion of the upper cover on the side near the work front, so that the boom is prevented from interfering with the upper cover even when the boom is inclined rearward to a large extent in the minimum-turn posture. Accordingly, the radius of turn of the work front in the minimum-turn posture can be reduced by inclining the boom rearward to a large extent in the minimum-turn posture. In this respect, the volume defined by the upper cover is reduced minimally, i.e., just in an amount corresponding to the provision of the recessed surface formed in the curved portion. Therefore, a space sufficient for installing necessary equipment can be ensured inside the upper cover.

In the above swing type hydraulic excavator, preferably, the turning frame is dimensioned to be turnable within the body width of the under traveling carriage or within a diameter close to the body width, and the work front is turnable within an area defined by the radius of turn of the tur ning frame.

Specifically, when the turning frame is dimensioned to be turnable within the body width of the under traveling carriage or within a diameter close to the body width, and the work front is turnable within an area defined by the radius of turn of the turning frame, the present invention is more effective because the space defined by the upper cover is more restricted.

In the above swing type hydraulic excavator, preferably, the boom of the work front is a two-piece boom made up of a lower boom and an upper boom, the work front includes a cross rod having one end coupled to the upper boom for changing an angle between the upper boom and the lower boom depending on a rotational angle of the lower boom, the swing post has a rear projecting portion to which the other end of the cross rod is coupled, and the curved portion further includes a first stepped portion provided at a lower end of the recessed surface and defining a substantially constant gap with respect to a locus drawn by the rear projecting portion of the swing post when the work front is swung.

Specifically, when the lower boom is raised and the work front is folded with intent to take the minimum-turn posture, the angle between the upper boom and the lower boom can be changed by the cross rod coupled at one end to the upper boom and at the other end to the rear projecting portion of the swing post. Therefore, the arrangement capable of turning the work front within the body width of the under traveling carriage or within the diameter close to the body width can be easily realized. Then, because of the curved portion including the first stepped portion defining the substantially constant gap with respect to the locus drawn by the rear projecting portion when the work front is swung, even when the work front is swung in the minimum-turn posture, a substantially constant gap is always maintained between the first stepped portion and the rear projecting portion, whereby interference between these two portions is prevented. Accordingly, it is possible to turn the work front within the body width of the under traveling carriage or within the diameter close to the body width, while ensuring a space sufficient for installation of necessary equipment inside the upper cover.

In the above swing type hydraulic excavator, preferably, the first stepped portion has a substantially vertical curved surface formed in continuation with a lower end of the recessed surface and defining a substantially constant gap with respect to the locus drawn by the rear projecting portion of the swing post when the work front is swung, and a substantially horizontal surface formed in continuation with the substantially vertical curved surface on the side near the work front and defining a substantially constant gap with respect to a locus drawn by a lower end of the rear projecting portion of the swing post when the work front is swung, the substantially vertical curved surface having a center axis aligned with the axis of the vertical pin, the substantially horizontal surface having a free edge in arcuate form having a center axis aligned with the axis of the vertical pin.

Specifically, when the boom is inclined rearward to a position laterally of the cab in the minimum-turn posture, there is a possibility that earth and sand adhering to the bucket, for example, may fall down on the curved portion unexpectedly, slide down over the recessed surface directly toward the vertical pin, and get jammed in a space around the vertical pin, thereby obstructing the rotation of the swing post, or get jammed in a space around an attachment end of the lower boom, thereby obstructing the rotation of the lower boom. Therefore, the substantially vertical curved surface and the substantially horizontal surface are formed in the first stepped portion so that earth and sand sliding down over the recessed surface are once accumulated on the substantially horizontal surface, and the earth and sand are then scraped out in the circumferential direction for discharge upon the rotating movement of the swing post. The spaces around the vertical pin and the attachment end of the lower boom can be thereby protected against jamming of earth and sand.

In the above swing type hydraulic excavator, preferably, the substantially horizontal surface has lower height in portions thereof near both circumferential ends than a portion thereof near the circumferential middle between the ends.

With this feature, the earth and sand once stored on the first stepped portion can be guided toward both the circumferential ends. As a result, the spaces around the vertical pin and the attachment end of the lower boom can be more surely protected.

In the above swing type hydraulic excavator, preferably, the curved portion further includes a second stepped portion provided in an intermediate portion of the recessed surface in the direction of height thereof and including a substantially horizontal surface to provide a foothold.

Specifically, by utilizing the substantially horizontal surface defining the second stepped portion as a foothold for the worker, walking access can be realized in maintenance and hence working efficiency can be increased.

BEST MODE FOR CARRYING OUT THE INVENTION

One embodiment of a swing type hydraulic excavator of the present invention will be described hereunder with reference to the drawings.

Embodiment

Figure 1:
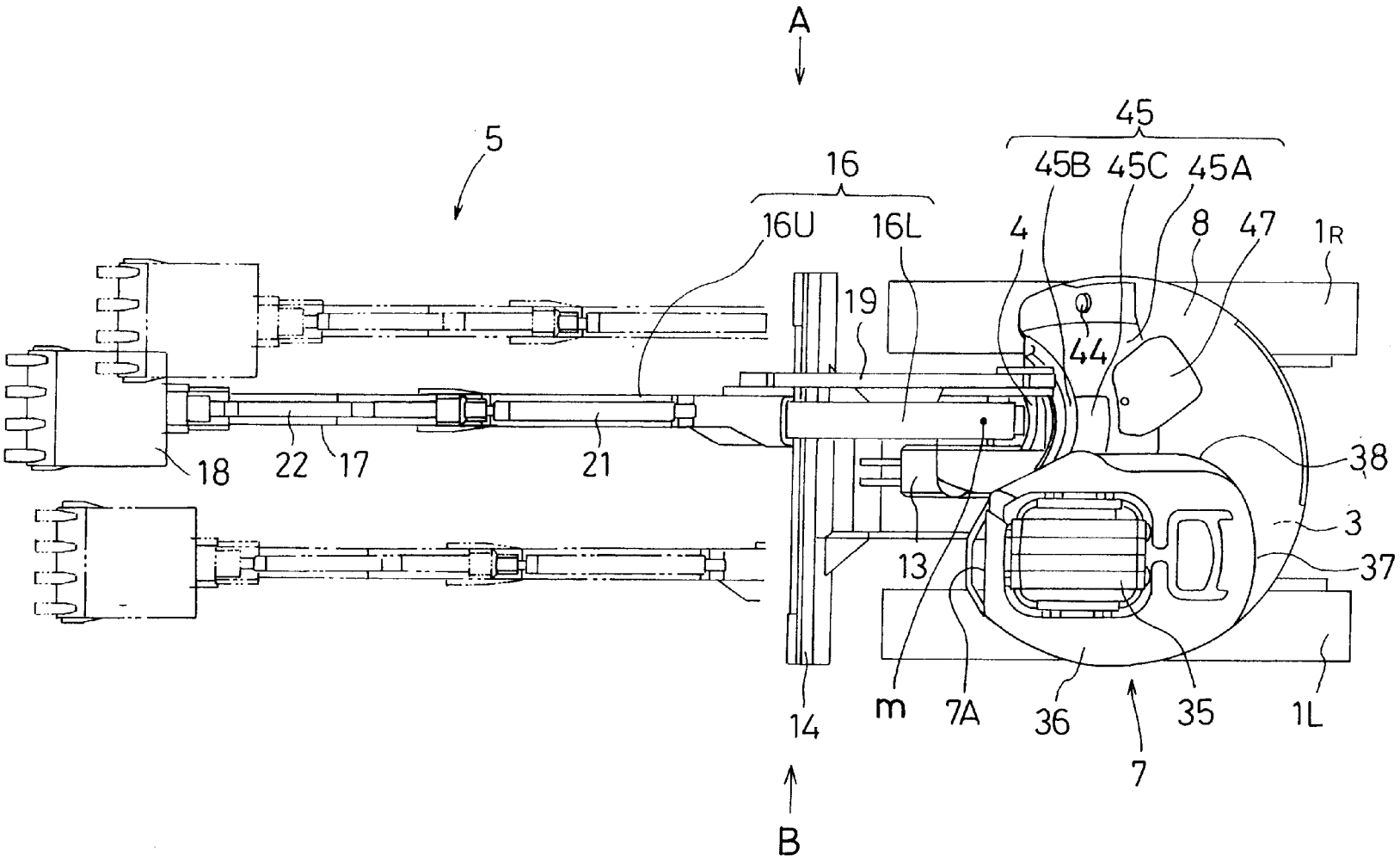
FIG. 1 is a top plan view showing an entire structure of a swing type hydraulic excavator according to one embodiment of the present invention.
Figure 2:
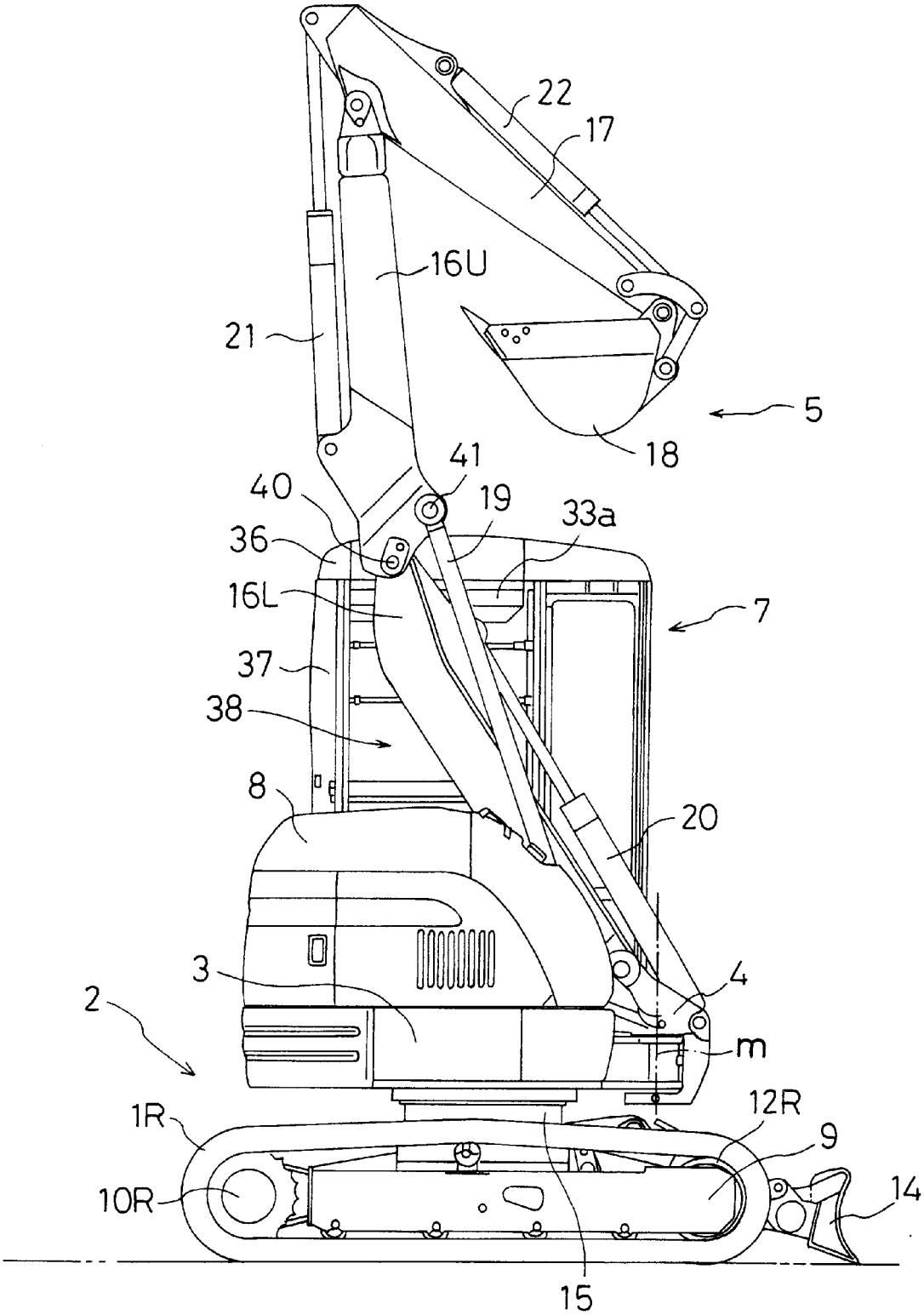
FIG. 2 is a side view looking from the direction A in FIG. 1.
Figure 3:
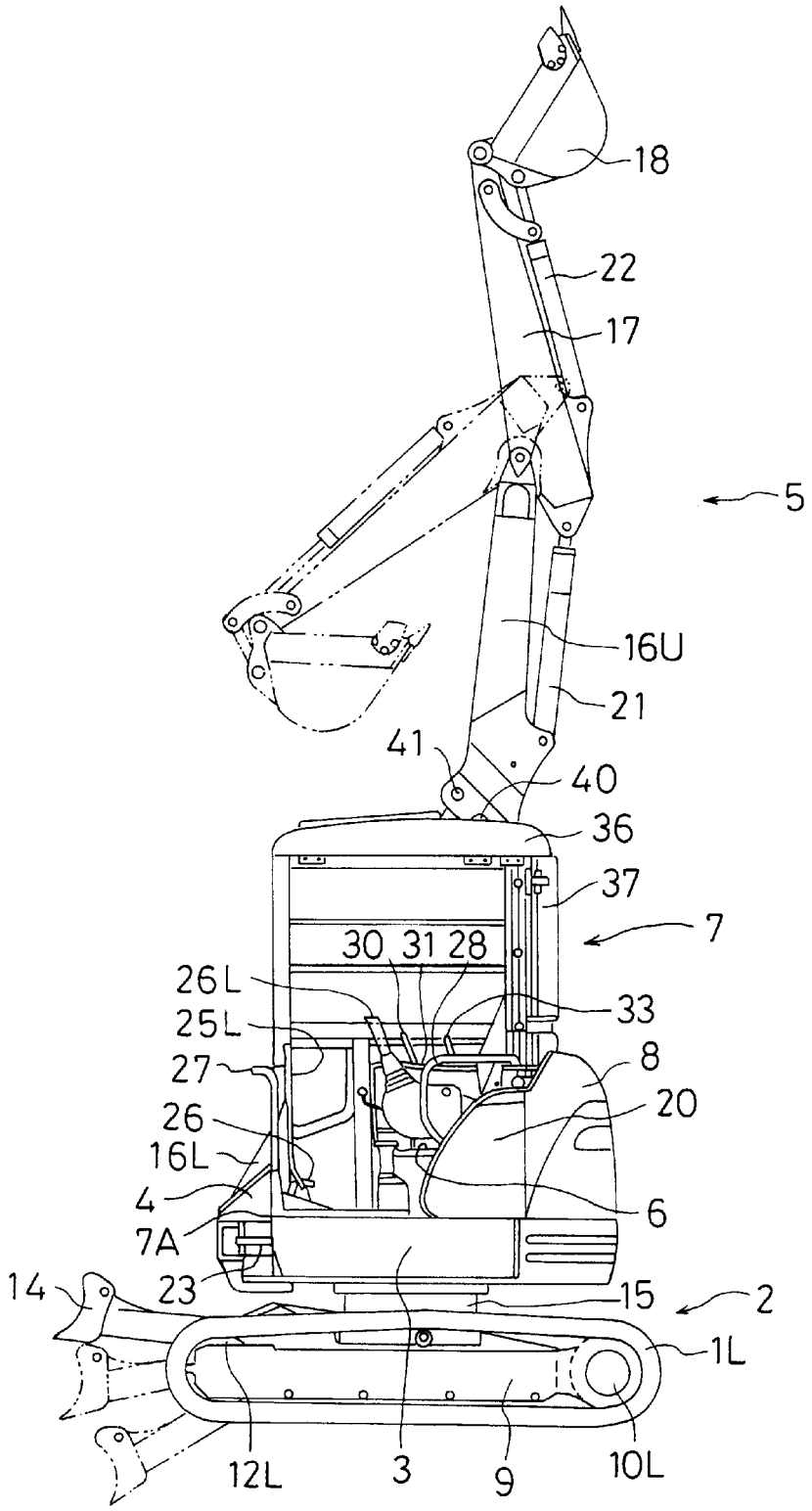
FIG. 3 is a side view looking from the direction B in FIG. 1.
Figure 4:
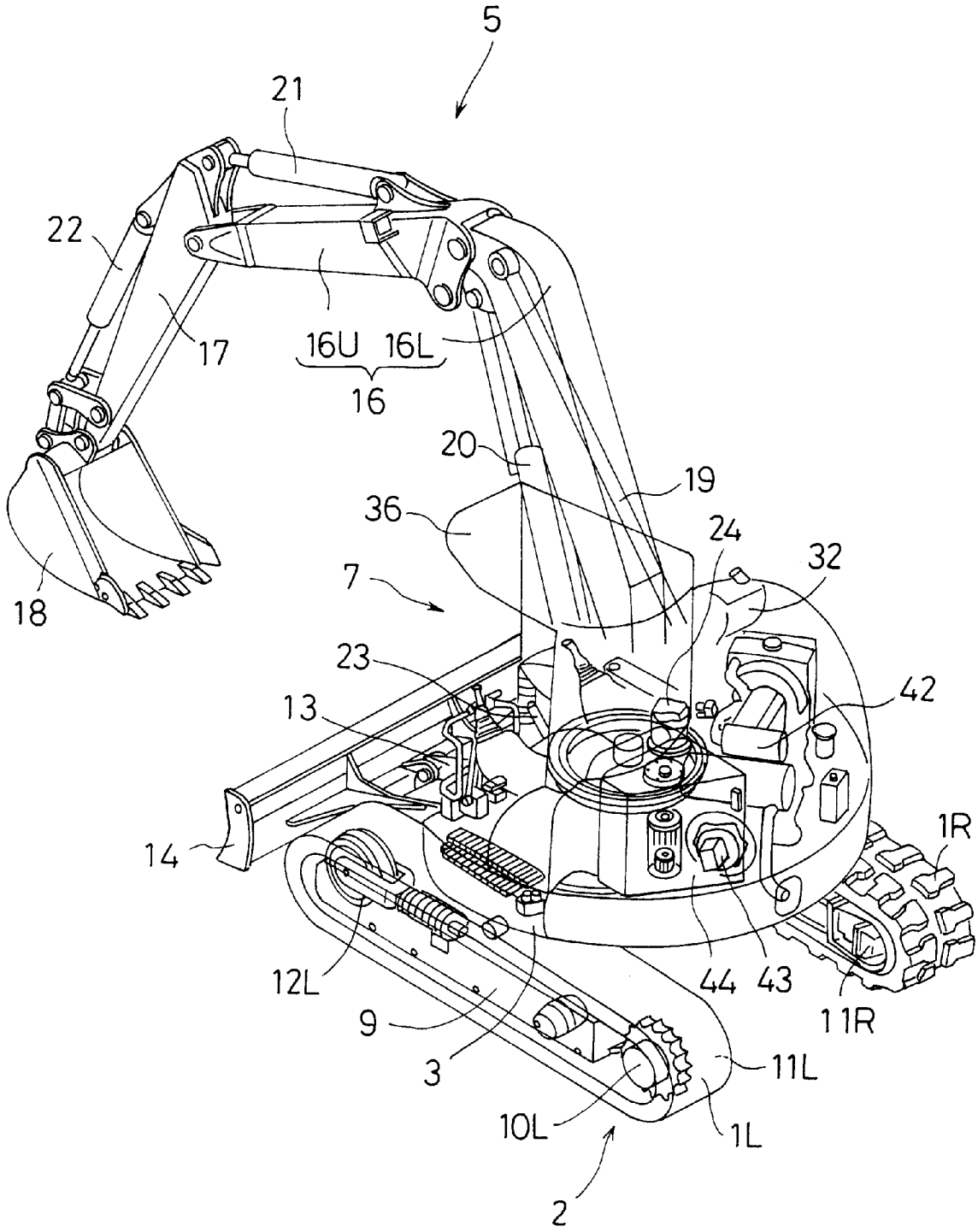
FIG. 4 is a perspective view of the hydraulic excavator show in FIG. 1, the view being partly seen through to show the interior.

FIG. 1 is a top plan view showing an entire structure of a swing type hydraulic excavator according to this embodiment, FIG. 2 is a side view looking from the direction A in FIG. 1, FIG. 3 is a side view looking from the direction B in FIG. 1, and FIG. 4 is a perspective view of the hydraulic excavator show in FIG. 1, the view being partly seen through to show the interior.

In FIGS. 1 to 4, the hydraulic excavator of this embodiment comprises an under traveling carriage 2 provided with left and right crawlers 1L, 1R serving as traveling means, a turning frame 3 turnably mounted above the under traveling carriage 2, a swing post 4 attached to the turning frame 3 rotatably in the horizontal direction about a vertical pin (not shown), a work front or mechanism 5 attached to the swing post 4 rotatably in the vertical direction, a cab 7 provided on the turning frame 3 and including a seat 6, and an upper cover 8 covering most of an area over the turning frame 3 except for the cab 7.

The under traveling carriage 2 comprises a track frame 9 substantially in the form of an "H", drive wheels 10L, 10R rotatably supported in positions on the left and right sides of the track frame 9 near a rear end thereof, left and right track motors 11L, 11R driving respectively the drive wheels 10L, 10R, rotating wheels (idlers) 12L, 12R rotatably supported in positions on the left and right sides of the track frame 9 near a front end thereof and rotated by respective driving forces of the drive wheels 10 through the crawlers 1L, 1R, and a blade 14 that moves up and down by a blade cylinder 13 for moving earth. In addition, a turning base bearing 15 is disposed at the center of the under traveling carriage 2.

The work front 5 comprises a two-piece boom 16 made up of a lower boom 16L and an upper boom 16U, an arm 17 rotatably coupled to the upper boom 16U, a bucket 18 rotatably coupled to the arm 17, and a cross rod 19 having one end coupled to the upper boom 16U for changing an angle between the upper boom 16U and the lower boom 16L. Then, the lower boom 16L, the arm 17 and the bucket 18 are operated respectively by a boom cylinder 20, an arm cylinder 21, and a bucket cylinder 22.

Figure 5A:
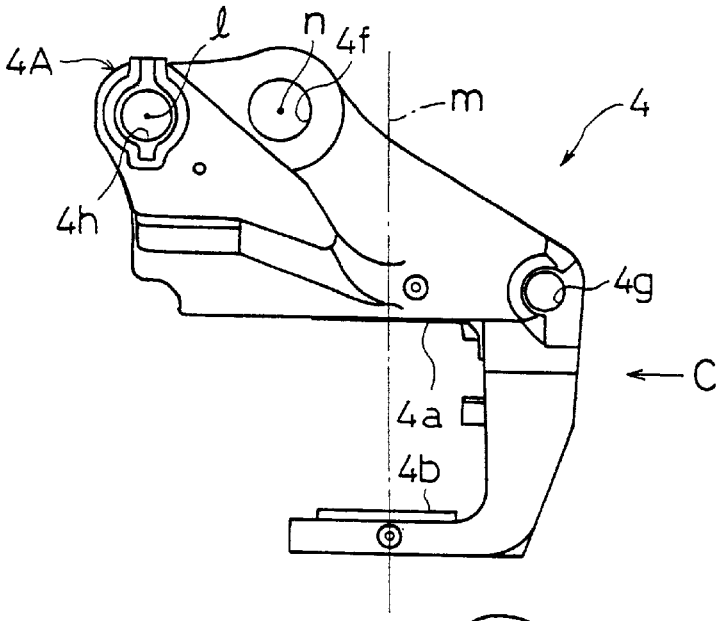
FIG. 5A is a side view of the swing post shown in FIG. 1.
Figure 5B:
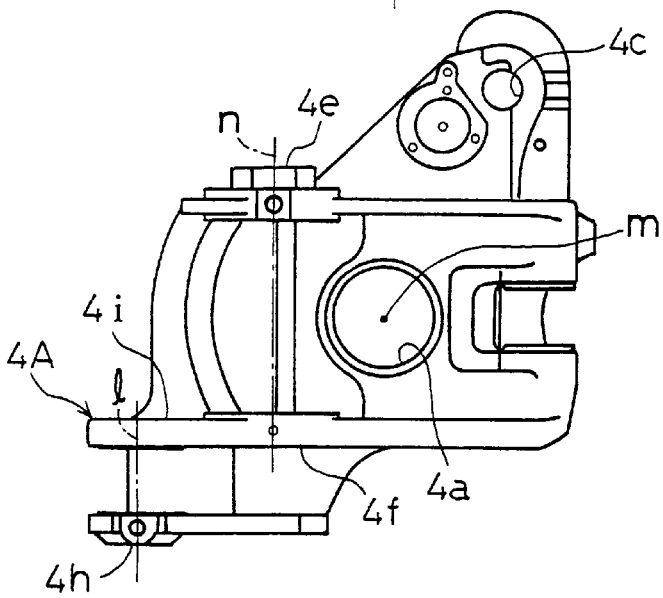
FIG. 5B is a top plan view of the swing post shown in FIG. 1.
Figure 5C:
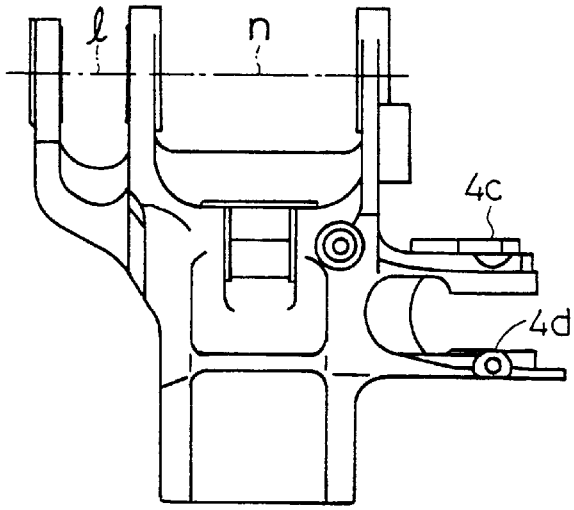
FIG. 5C is a fron view of the swing post shown in FIG. 1.

Here, a detailed structure of the swing post 4, to which the work front 5 is attached, is shown in FIGS. 5A, 5B and 5C. FIGS. 5A and 5B are side and top plan views of the swing post 4, respectively, and FIG. 5C is a front view of the swing post looking from the direction C in FIG. 5A.

In FIGS. 5A to 5C and FIG. 2, the swing post 4 is rotatable about an axis m with respect to the turning frame 3 through the vertical pin (not shown) inserted in holes 4*a*, 4*b*. Also, the swing post 4 is coupled to a swing cylinder 23, which is provided on the turning frame 3, through a joint pin (not shown) inserted in holes 4*c*, 4*d*. Upon extension and contraction of the swing cylinder 23, the swing post 4 is entirely rotated about the axis m, causing the work front 5 to swing to the left and right.

Further, one end of the lower boom 16L is rotatably coupled to the swing post 4 about an axis n through a joint pin (not shown) inserted in holes 4*e*, 4*f*. Moreover, a bottom portion of the boom cylinder 20 for operating the lower boom 16L is rotatably coupled to the swing post 4 through a joint pin (not shown) inserted in a hole 4*g*. At the same time, the other end of the cross rod 19 coupled at its one end to the upper boom 16U is rotatably coupled to the swing post 4 about an axis 1 through a joint pin (not shown) inserted in holes 4*h*, 4*i* which is formed in a rear projecting portion 4A. With this structure, the cross rod 19 functions as a link member for restricting a shape of the work front and changes an angle between the upper boom 16U and the lower boom 16L depending on the rotational angle of the lower boom 16L with respect to the turning frame 3.

Returning to FIGS. 1 to 4, a turning motor 24 for turning the turning frame 3 with respect to the under traveling carriage 2 is disposed near the center of the turning frame 3. In this connection, as shown in FIG. 1, the turning frame 3 is dimensioned such that it is turnable within a diameter close to the body width of the under traveling carriage 2 (=diameter slightly larger than the body width).

Further, when the work front 5 is brought into a minimum-turn posture where the boom 16 is maximally lifted upward so as to be in a position closest to the upper cover 8 (hereinafter referred to simply as a minimum-turn posture of the work front), the cross rod 19 coupled to the upper boom 16U and the rear projecting portion 4A of the swing post 4 moves to change the angle between the upper boom 16U and the lower boom 16L as the lower boom 16 is raised and the work front 5 is folded. As a result, the boom 16 is inclined rearward to a position laterally of the cab 7 (see FIG. 2), allowing the work front 5 to turn within an area defined by the radius of turn of the turning frame 3, i.e., within the diameter close to the body width of the under traveling carriage 2. Then, at this time, the position of the vertical pin (axis m) inserted in the holes 4*a,* 4*b* of the swing post 4 is located within the radius of turn of the turning frame 3, as shown in FIG. 1. Note that though the above-mentioned hydraulic actuators, i.e., the blade cylinder 13, the turning motor 24, the boom cylinder 20, the arm cylinder 21, the bucket cylinder 22, the swing cylinder 23, and the left and right track hydraulic motors 11, are not especially described here in detail, they are driven by any of the known hydraulic drive systems (as disclosed in, e.g., JP, A, 7-189298 and JP, A, 7-26592).

Figure 6:
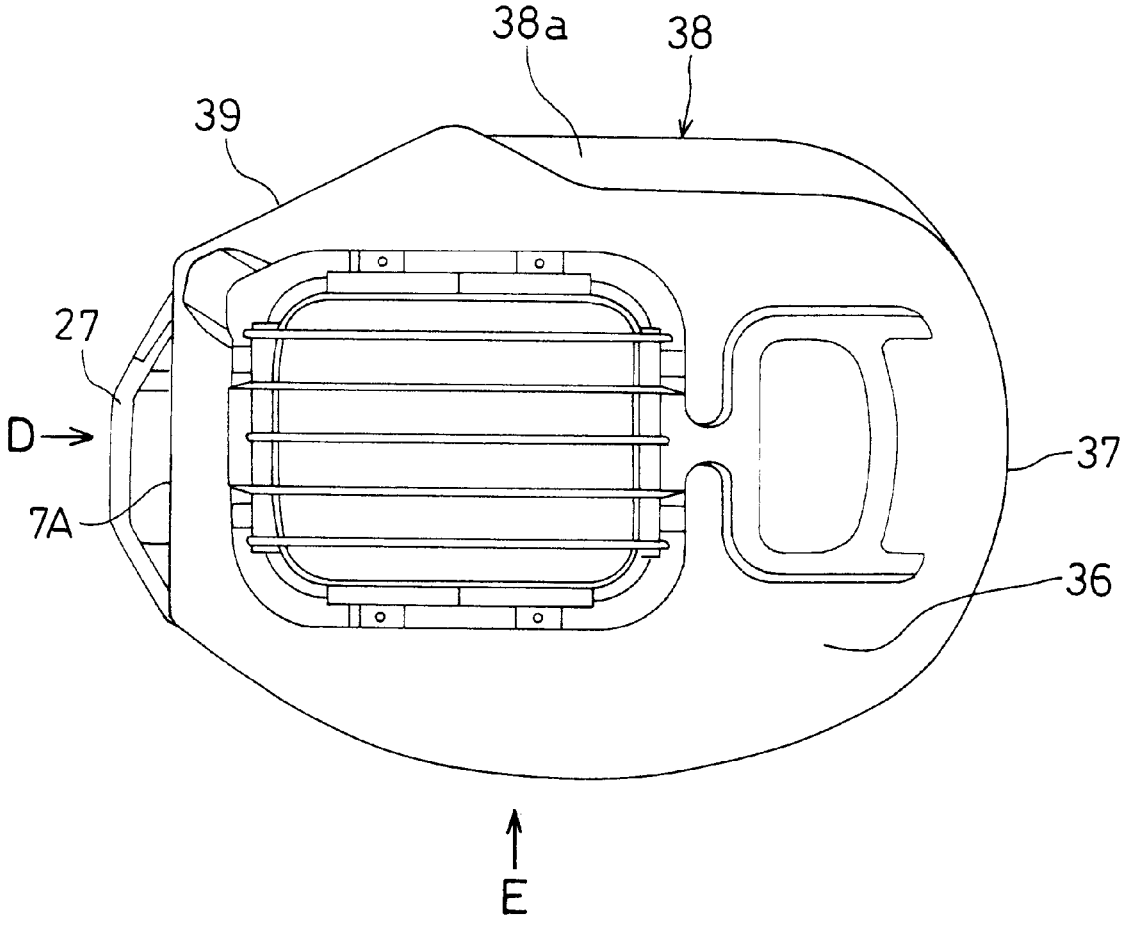
FIG. 6 is a top plan view of a cab shown in FIG. 1.
Figure 7:
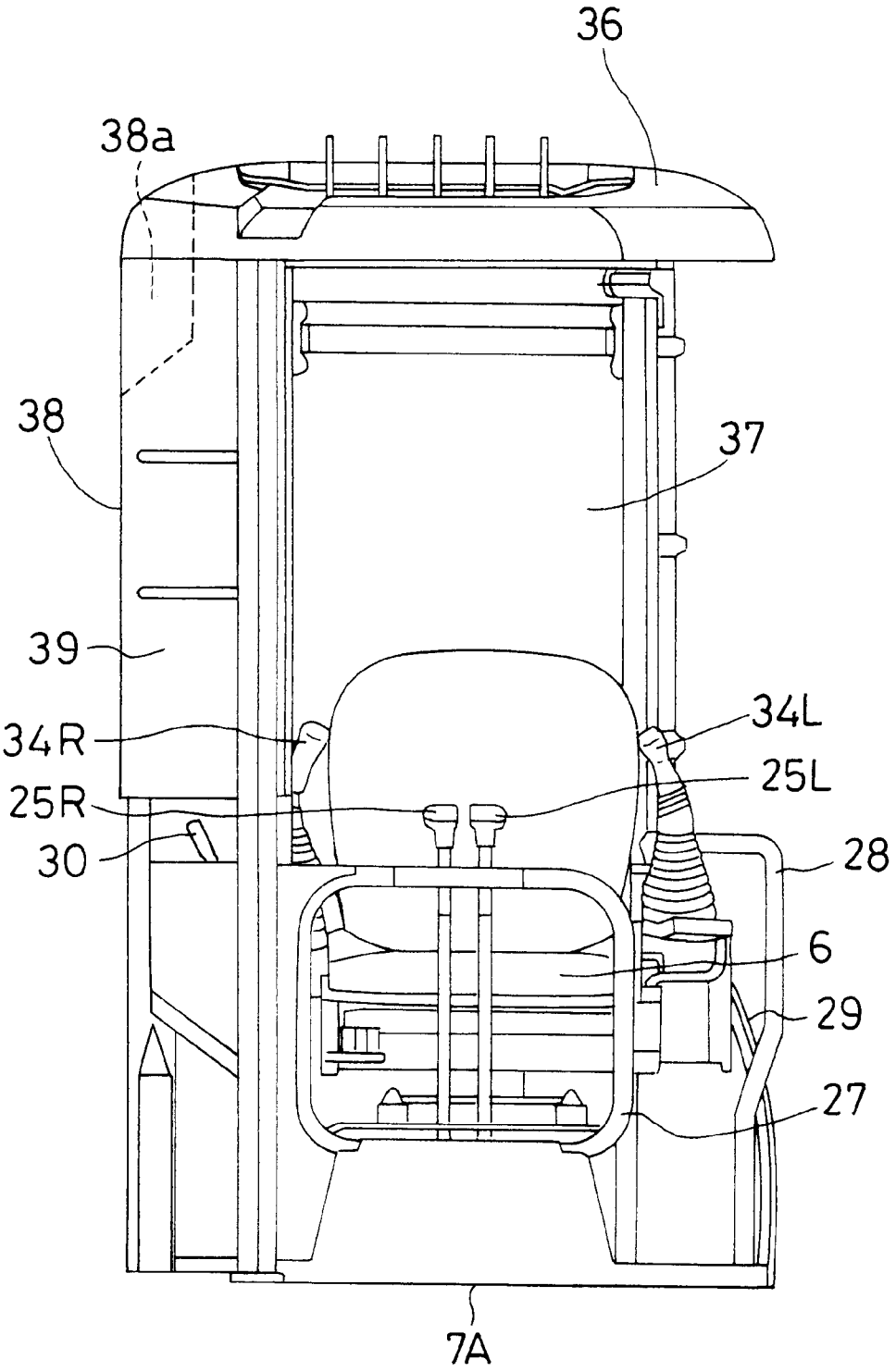
FIG. 7 is a front view looking from the direction D in FIG. 6.
Figure 8:
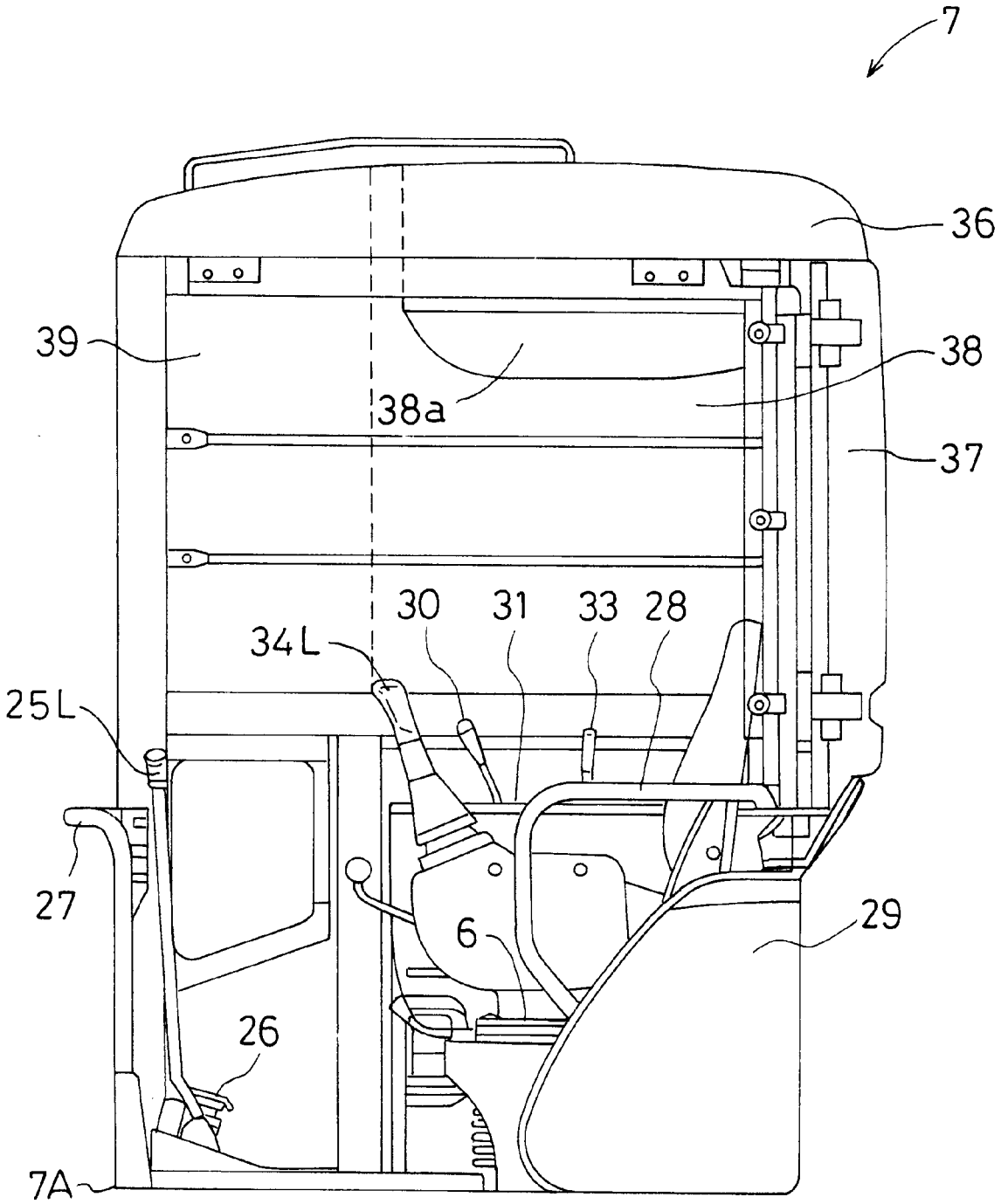
FIG. 8 is a side view looking from the direction E in FIG. 6.

On the other hand, the cab 7 is provided on the left side of the turning frame 3. A detailed structure of the cab 7 is shown in FIGS. 6 to 8. FIG. 6 is a top plan view of the cab 7, FIG. 7 is a front view looking from the direction D in FIG. 6, and FIG. 8 is a side view looking from the direction E in FIG. 6.

Referring to FIGS. 6 to 8, in front of the seat 6 in the cab 7, there are disposed left and right travel levers 25L, 25R for driving respectively the left and right track hydraulic motors 11L, 11R of the under traveling carriage 2, a swing pedal 26 for driving the swing cylinder 23 to swing the work front 5, and a front stay 27 for protecting the operator from falling down forward. On the left side of the seat 6, a side stay 28 and a side cover 29 are provided for protecting the operator from falling down to the left. On the right side of the seat 6, there are disposed a blade lever 30 for driving the blade cylinder 13 to move the blade 14 vertically, a switch/monitor panel 31 including various switches and monitors built therein, and a fuel lever 33 for controlling fuel supply from a fuel tank 32. Further, on both sides of the seat 6, there are disposed left and right work levers 34L, 34R for driving the boom cylinder 20, the arm cylinder 21 and the bucket cylinder 22 to operate the lower boom 16L, the arm 17 and the bucket 18, respectively.

Further, the cab 7 comprises a roof 36 provided above the seat 6 and having a skylight 35 formed therein, a rear wall 37 provided behind the seat 6, a side wall 38 provided inward and laterally (on the right side) of the seat 6, and a slant wall 39 provided such that it extends in continuation with the side wall 38 and its end on the side near the work front 5 reaches a front edge portion 7A of the cab 7 in horizontal cross-sectional view. Additionally, a portion of the side wall 38 near its upper end is recessed toward the interior of the cab 7, thereby forming a recessed portion 38a. With the presence of the recessed portion 38*a,* parts near a joint pin 40 between the lower boom 16L and the upper boom 16U and a joint pin 41 between the cross rod 37 and the upper boom 16U are prevented from interfering with the side wall 38 in the minimum-turn posture of the work front (see FIG. 2).

Any of the rear wall 37, the side wall 38 and the slant wall 39 is made of a transparent material in most of its area and disposed substantially vertically. The slant wall 39 is substantially flat. The side wall 38 is also substantially flat in its portion near the slant wall 39 except the recessed portion 38a, but is curved in its portion near the rear wall 37. The rear wall 37 has a curved surface.

Inside the upper cover 8, as shown in FIG. 4, there are installed various equipment such as an engine 42, a hydraulic pump 43 driven by the engine 42, the fuel tank 32 for storing fuel for the engine 42, and a working oil tank 44 serving as a hydraulic fluid source of the hydraulic pump 43. More specifically, the engine 42, the hydraulic pump 43 and the fuel tank 32 are disposed inside the upper cover 8 on the right side of the cab 7, and the working oil tank 44 serving as the hydraulic fluid source of the hydraulic pump 43 is disposed inside the upper cover 8 behind the cab 7. The upper cover 8 which is an important part of this embodiment will be described below with reference to FIGS. 9 to 11.

Figure 9:
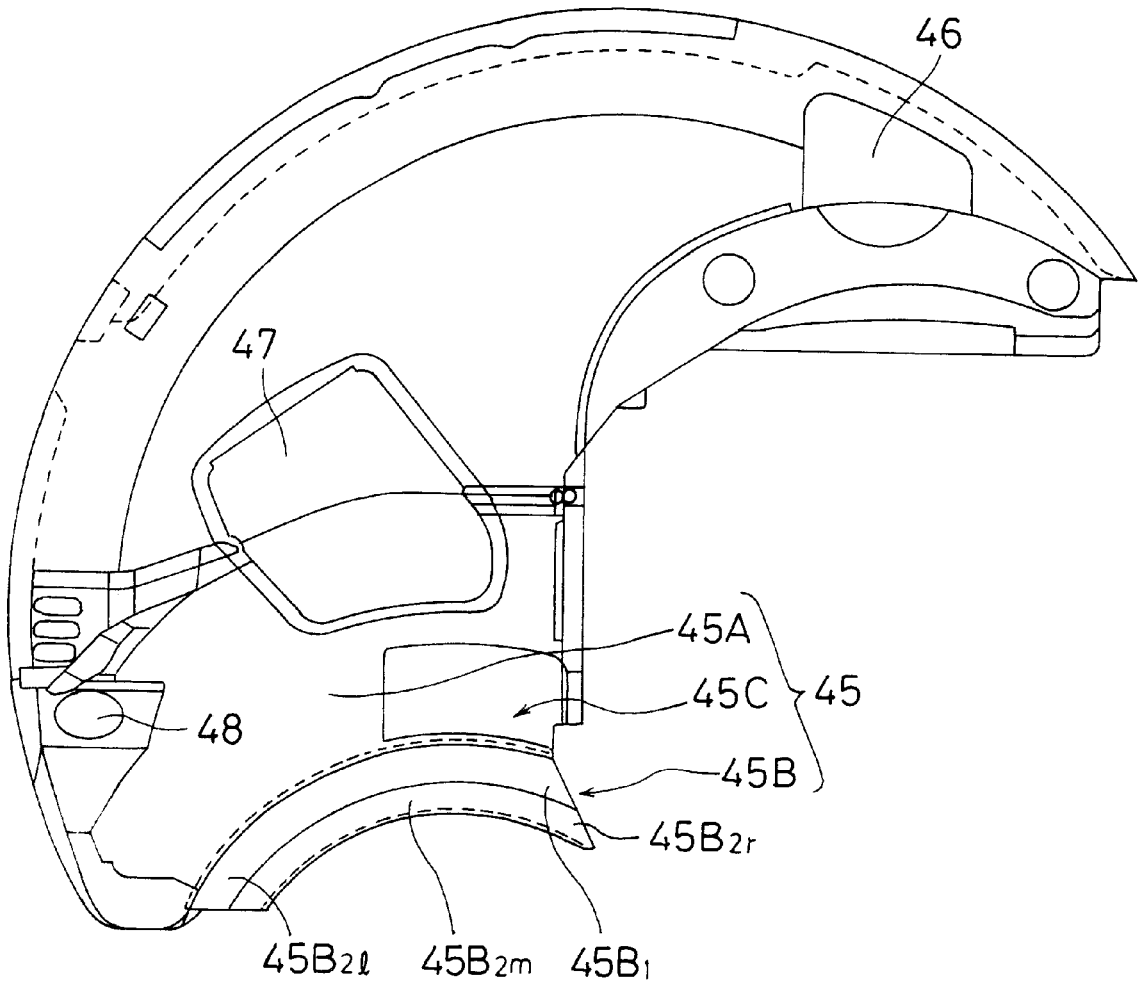
FIG. 9 is a top plan view showing a detailed structure of an upper cover shown in FIG. 1.
Figure 10:
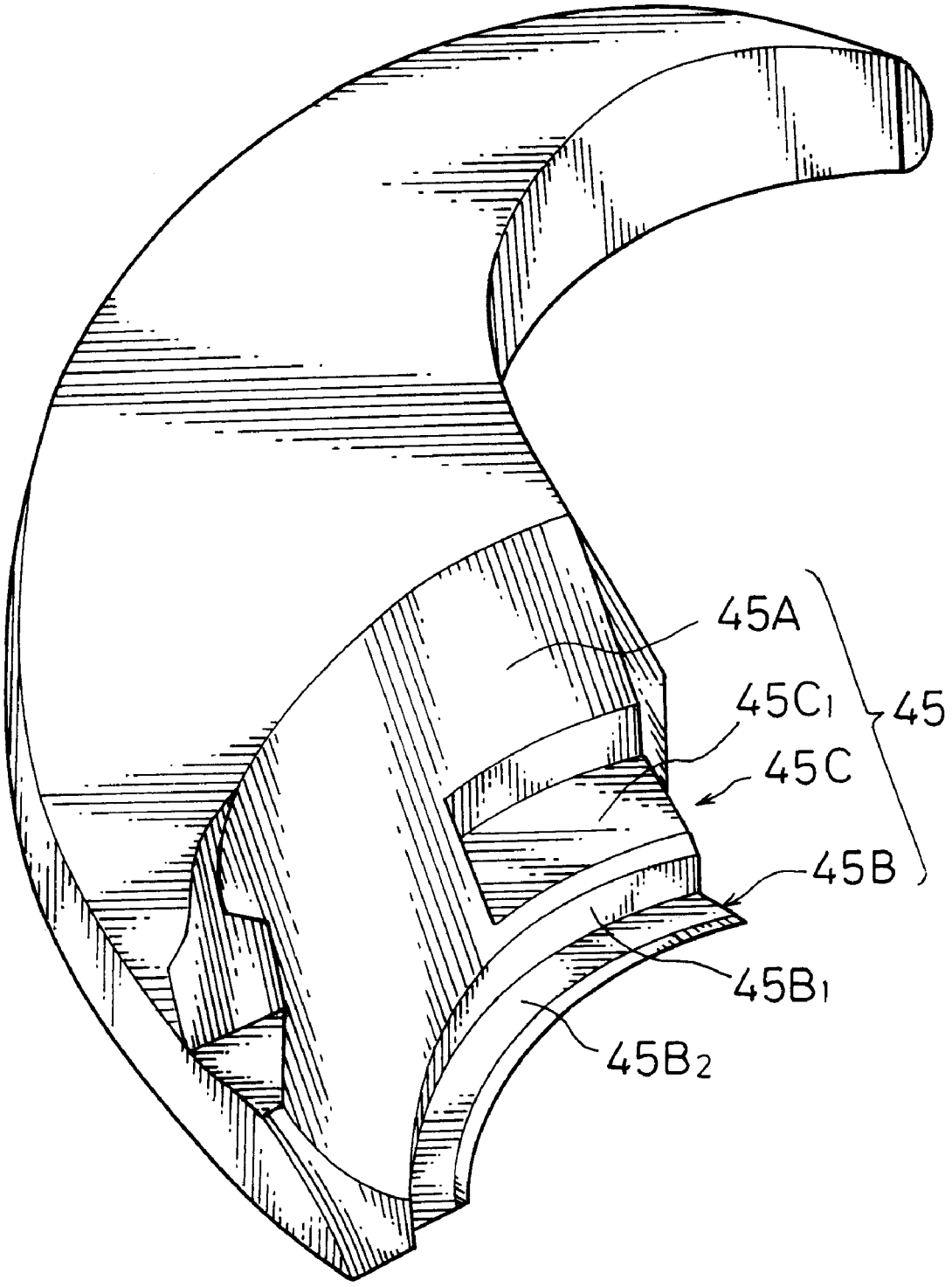
FIG. 10 is a perspective view showing a schematic structure of the upper cover shown in FIG. 1.
Figure 11:
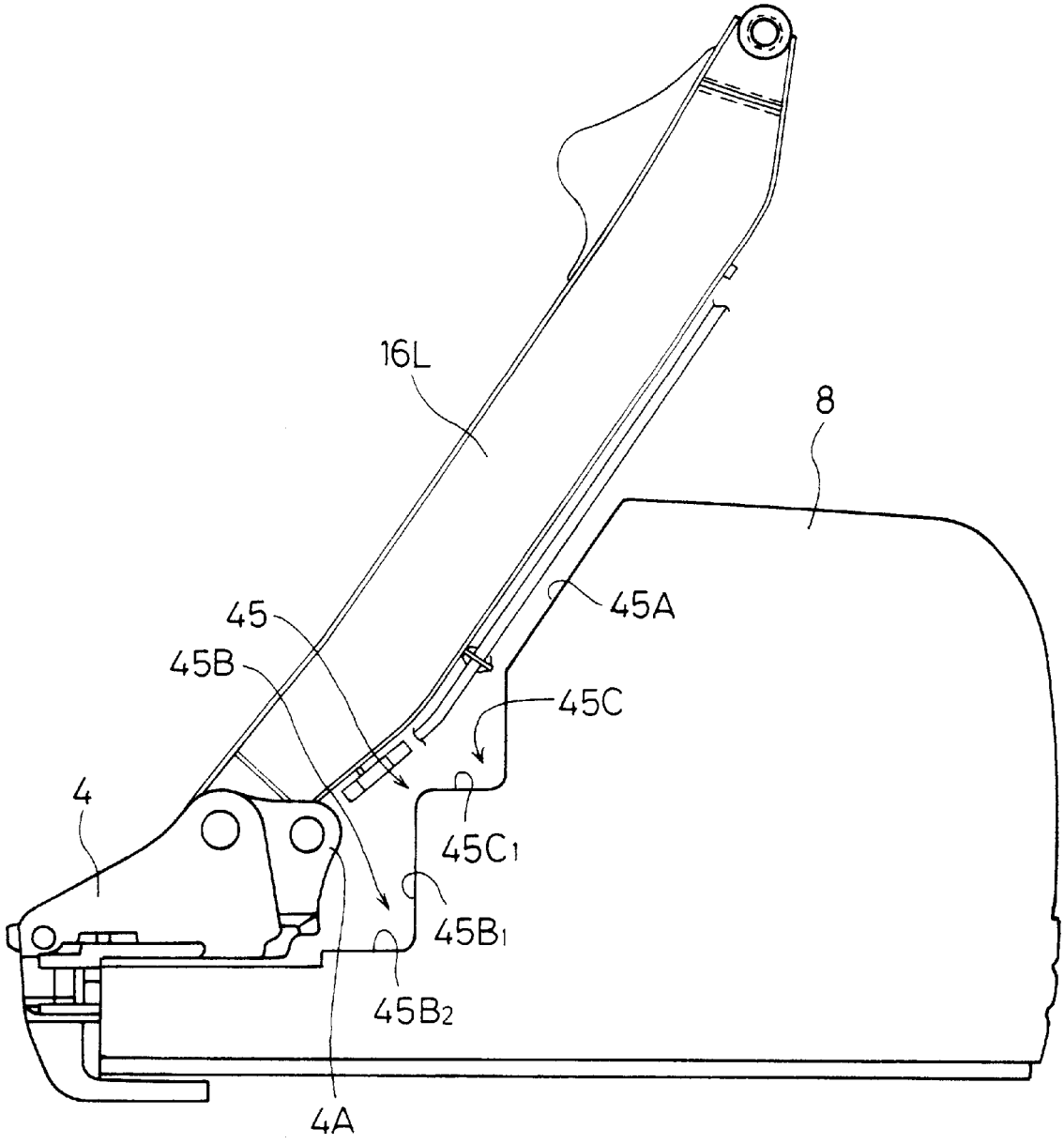
FIG. 11 is an explanatory sectional view showing the positional relationship between a curved portion and a lower boom in a minimum-turn posture of a work front.

FIGS. 9 and 10 are a top plan view showing a detailed structure of the upper cover 8 and a perspective view showing a schematic structure of the upper cover 8, respectively, and FIG. 11 is an explanatory sectional view showing the positional relationship between a curved portion (described later) and the lower boom 16L in the minimum-turn posture of the work front. In FIGS. 9 to 11 and FIG. 1, the upper cover 8 has a curved portion 45 formed in its end portion on the side near the work front 5 for avoiding interference with the work front 5. The curved portion 45 comprises a recessed surface 45A having a center axis aligned with the axis m (see FIG. 1) of the vertical pin of the swing post 4, a first stepped portion 45B provided at a lower end of the recessed surface 45A and defining a substantially constant gap with respect to a locus drawn by the rear projecting portion 4A of the swing post 4 when the work front 5 is swung (see FIG. 11), and a second stepped portion 45C provided in an intermediate portion of the recessed surface 45A in the direction of height thereof and having a substantially horizontal surface 45C1 for assuring a foothold.

The recessed surface 45A is configured (e.g., cone-shaped, see FIG. 11) to extend along a locus drawn by a back surface of the boom 16 when the work front 5 is swung in the minimum-turn posture, while defining a gap with respect to the locus.

The first stepped portion 45B has a substantially vertical curved surface 45B1 (see FIG. 11) formed in continuation with the lower end of the recessed surface 45A and defining a substantially constant gap with respect to the locus drawn by the rear projecting portion 4A of the swing post 4 when the work front 5 is swung, and a substantially horizontal surface 45B2 (see FIG. 11) formed in continuation with the curved surface 45B1 on the side near the work front 5 and defining a substantially constant gap with respect to a locus drawn by a lower end of the rear projecting portion 4A of the swing post 4 when the work front 5 is swung. The substantially vertical curved surface 45B1 has a shape having a center axis aligned with the axis m of the vertical pin of the swing post 4. The substantially horizontal surface 45B2 is configured such that its free edge is in an arcuate form having a center axis aligned with the axis m of the vertical pin and its portions near both circumferential ends 45B21, 45B2*r* have lower height than its portion near the circumferential middle 45B2*m*.

In addition to the above, the upper cover 8 further includes an oil tank cover 46 for covering the working oil tank 44, an inspection cover 47 opened and closed in maintenance, and an oil supply hole 48 through which the fuel is replenished to the fuel tank 32.

This embodiment constructed as described above operates as follows.

When the work front 5 is swung in the minimum-turn posture with the boom 16 positioned closest to the upper cover 8, the back surface of the boom 16 draws a locus having a center axis aligned with the axis m of the vertical pin. Accordingly, when the boom 16 is going to be inclined rearward to a large extent in the minimum-turn posture, the boom 16 and the upper cover 8 would interfere with each other somewhere in the above locus if the upper cover 8 had no recessed surface portion. In this embodiment, therefore, the curved portion 45 is formed in the end portion of the upper cover 8 on the side near the work front 5, and the recessed surface 45A, which is configured to have the center axis aligned with the axis m of the vertical pin and extend along the above locus while defining a gap with respect to the above locus, is formed in the curved portion 45. With this structure, the boom 16 is prevented from interfering with the upper cover 8 even when the boom 16 is inclined rearward to a large extent in the minimum-turn posture. The structure also has an additional advantage that since earth and sand falling from the bucket 18 in a slight turn, for example, are likely to slide down along the recessed surface 45A, a build-up of earth and sand on the upper cover 8 is suppressed.

Also, in the curved portion 45, the first stepped portion 45B defining the substantially constant gap with respect to the locus drawn by the rear projecting portion 4A of the swing post 4 when the work front 5 is swung, is provided. Therefore, even when the work front 5 is swung in the minimum-turn posture, a substantially constant gap is always maintained between the first stepped portion 45B and the rear projecting portion 4A, whereby interference between these two portions is prevented.

Accordingly, the above two interference preventing functions permit the boom 16 to be inclined rearward to a large extent in the minimum-turn posture. As a result, the work front 5 can be turned within the radius of turn of the turning frame 3, i.e., within the diameter close to the body width of the under traveling carriage 2.

When the boom 16 is inclined rearward to a position laterally of the cab 7 in the minimum-turn posture, there is a possibility that earth and sand adhering to the bucket 18, for example, may fall down on the curved portion 45 unexpectedly, slide down over the recessed surface 45A directly toward the vertical pin, and get jammed in a space around the vertical pin, thereby obstructing the rotation of the swing post 4, or get jammed in a space around an attachment end of the lower boom 16L, thereby obstructing the rot ation of the lower boom 16L. In this embodiment, therefore, the substantially vertical curved surface 45B1 and the substantially horizontal surface 45B2 are formed in the first stepped portion 45B so that earth and sand sliding down over the recessed surface 45A are once accumulated on the substantially horizontal surface 45B2, and the earth and sand are then scraped out in the circumferential direction for discharge upon the rotating movement of the swing post 4. The spaces around the vertical pin and the attachment end of the lower boom 16L can be thereby protected against jamming by earth and sand. In this connection, since the substantially horizontal surface 45B2 has a lower height in its portions near both the circumferential ends 45B21, 45B2*r* than its portion near the circumferential middle 45B2*m*, the earth and sand once stored on the first stepped portion 45B can be guided toward both the circumferential ends 45B21, 45B2*r*. As a result, the spaces around the vertical pin and the attachment end of the lower boom 16L can be more surely protected.

Further, by utilizing the substantially horizontal surface 45C1 of the second stepped portion 45C as a foothold for the worker, walking access can be realized in maintenance and hence working efficiency can be increased.

In the above structure, the volume defined by the upper cover 8 is reduced minimally, i.e., just in amount corresponding to the provision of the recessed surface 45A, the first stepped portion 45B and the second stepped portion 45C. Therefore, a space sufficient for installing the necessary equipments can be ensured inside the upper cover 8.

While the above embodiment is constructed such that the turning frame 3 is turnable within the diameter close to the body width of the under traveling carriage 2 (i.e., the diameter slightly larger than the body width) and the work front 5 is turnable within the radius of turn of the turning frame 3 in the minimum-turn posture, the present invention is not limited to such a construction. In other words, the present invention is also applicable to a hydraulic excavator wherein the turning frame 3 is turnable within a diameter somewhat larger than the under traveling carriage 2, a hydraulic excavator wherein the turning frame 3 is turnable within the body width of the under traveling carriage 2 contrary to the above case, a hydraulic excavator wherein the work front 5 is turnable within an area slightly larger than (but close to) the radius of turn of the turning frame 3, and a hydraulic excavator wherein the work front 5 is turnable within an area somewhat larger than the radius of turn of the turning frame 3. Any of these cases can also provide the advantages specific to the present invention, i.e., that the radius of turn of the work front 5 in the minimum-turn posture can be reduced while minimizing a reduction in volume defined by the upper cover 8. It is to be noted that the present invention is more effective in hydraulic excavators wherein the turning frame 3 is turnable within a smaller diameter and hydraulic excavators wherein the work front 5 is turnable within a smaller diameter in the minimum-turn posture, because the space inside the upper cover 8 is more restricted in those hydraulic excavators.

Further, the above embodiment has been described, by way of example, in connection with a hydraulic excavator having the boom 16 of a so-called two-piece boom type. However, the present invention is not limited to the above embodiment, and may be applied to a hydraulic excavator having a boom of a so-called mono-boom type as well. In this case, similar advantages as with the above embodiment can also be obtained.

INDUSTRIAL APPLICABILITY

According to the present invention, even when the boom is inclined rearward to a large extent in the minimum-turn posture, the work front and the upper cover can be prevented from interfering with each other due to the presence of the recessed surface provided in the curved portion.

Consequently, the radius of turn of the work front in the minimum-turn posture can be reduced while minimizing a reduction in volume defined by the upper cover.

We claim:

1. A swing type hydraulic excavator comprising an under traveling carriage, a turning frame turnably mounted above said under traveling carriage, a swing post attached to said turning frame rotatably in the horizontal direction about a vertical pin, a work mechanism attached to said swing post rotatable in the vertical direction and including a boom, a cab provided on said turning frame on one side in the direction of body width, and an upper cover covering most of an area over said turning frame except said cab and housing equipment such as a drime mover, a hydraulic pump and a tank therein, a rotational angle of said swing post being circumscribed in the direction of which said work mechanism approaches said cab, said boom of said work mechanism being inclined rearward to a position laterally of said cab when said boom is maximally lifted upward to take a minimum-turn posture of said work mechanism where said boom is closest to said upper cover, thereby reducing a radius of turn of said work mechanism in said minimum-turn posture, wherein:

a curved portion for avoiding interference with said work mechanism is formed in an end portion of said upper cover on a side near said work mechanism, and said curved portion includes a recessed surface configured to have a center axis aligned with an axis (m) of said vertical pin and extend along a locus drawn by a back surface of said boom when said work mechanism is swung in said minimum-turn posture, while defining a gap with respect to said locus;

wherein said turning frame is dimensioned to be turnable within the body width of said under traveling carriage or within a diameter close to the body width, and said vertical pin is located on said turning frame so that said work mechanism is turnable within an area defined by a radius of turn of said turning frame;

wherein said boom of said work mechanism is a two-piece boom made up of a lower boom and an upper boom, said work mechanism includes a cross rod having one end coupled to said upper boom for changing an angle between said upper boom and said lower boom depending on a rotational angle of said lower boom, said swing post has a rear projecting portion to which the other end of said cross rod is coupled, and said curved portion further includes a first stepped portion provided at a lower end of said recessed surface and defining a substantially constant gap with respect to a locus drawn by the rear projecting portion of said swing post when the work mechanism is swung.

2. A swing type hydraulic excavator according to claim 1, wherein said first stepped portion has a substantially vertical curved surface formed in continuation with a lower end of said recessed surface and defining a substantially constant gap with respect to the locus drawn by the rear projecting portion of said swing post when said work mechanism is swung, and a substantially horizontal surface formed in continuation with said substantially vertical curved surface on the side near said work mechanism and defining a substantially constant gap with respect to a locus drawn by a lower end of the rear projecting portion of said swing post when said work mechanism is swung, said substantially vertical curved surface having a center axis aligned with the axis (m) of said vertical pin, said substantially horizontal surface having a free edge in an arcuate form having a center axis aligned with the axis (m) of said vertical pin.

3. A swing type hydraulic excavator according to claim 2, wherein said substantially horizontal surface has circumferential ends and a circumferential middle between the circumferential ends, including a lower height in portions thereof near both circumferential ends than a portion thereof near the circumferential middle.

4. A swing type hydraulic excavator according to claim 1, wherein said curved portion further includes a second stepped portion provided in an intermediate portion of said recessed surface in the direction of height thereof and including a substantially horizontal surface to provide a foothold.

* * * * *